US005660531A

United States Patent [19]

Merkle et al.

[11] Patent Number: 5,660,531

[45] Date of Patent: Aug. 26, 1997

[54] GEAR PUMP WITH MINIMIZED CANITATION

[75] Inventors: Hans Merkle, Stuttgart; Ralf Brunst, Ditzingen, both of Germany

[73] Assignee: Mercedes-Benz AG, Stuttgart, Germany

[21] Appl. No.: 635,266

[22] Filed: Apr. 15, 1996

[30] Foreign Application Priority Data

Apr. 13, 1995 [DE] Germany ..... 195 14 021.4

[51] Int. Cl.[6] ..... F04B 49/02; F04C 2/10; F04C 15/02

[52] U.S. Cl. ..... 417/300; 417/310; 418/15; 418/170

[58] Field of Search ..... 417/300, 310, 417/440, 503; 418/15, 170, 171, 206.4

[56] References Cited

U.S. PATENT DOCUMENTS

| | | | |
|---|---|---|---|
| 2,774,309 | 12/1956 | Stoyke et al. | 418/170 |
| 3,182,596 | 5/1965 | Prijatel | 417/310 |
| 3,291,060 | 12/1966 | Bottoms | 418/170 |
| 3,356,032 | 12/1967 | Roeske | 418/180 |
| 3,635,604 | 1/1972 | Petersen et al. | 417/310 |
| 3,730,656 | 5/1973 | Lambeth | 418/170 |
| 3,824,041 | 7/1974 | Rystrom | 417/310 |

FOREIGN PATENT DOCUMENTS

| | | | |
|---|---|---|---|
| 1 553 014 | 8/1969 | Germany . | |
| 17 03 802 B2 | 4/1972 | Germany . | |
| 2 116 317 | 10/1972 | Germany . | |
| 29 33 493A1 | 3/1981 | Germany . | |
| 34 10015 A1 | 9/1985 | Germany . | |
| 4272488 | 9/1992 | Japan | 417/300 |

OTHER PUBLICATIONS

DEA2933493 (Daimler-Benz AG) Answer 1, 1996, Derwent Information Ltd. Abstract of patent document.

*Primary Examiner*—John J. Vrablik

*Attorney, Agent, or Firm*—Evenson McKeown Edwards & Lenahan, PLLC

[57] ABSTRACT

The invention relates to a gear pump with two delivery gears meshing with one another, said gears cooperating in the rotation direction in front of or behind a plane containing the gear axes with a pressure and/or suction line. According to the invention, excess delivered pumping medium is introduced through a separate line behind the connection of the suction line in the circumferential direction of the gears, into the tooth spaces of the delivery gears in order to prevent any cavitation that might occur.

9 Claims, 2 Drawing Sheets

GEAR PUMP WITH MINIMIZED CANITATION

BACKGROUND AND SUMMARY OF THE INVENTION

The invention relates to a gear pump with at least two delivery gears meshing with one another, whose gear teeth tip circles intersect at crossing points on both sides of a plane containing the gear axes and whose teeth form a pressure zone in front of said plane in the rotation direction of the delivery gears, and a suction zone behind said plane in the rotation direction. The pressure zone communicates with a kidney/cardioid shaped pressure chamber. A pressure line communicates with the pressure chamber. The suction zone extends beyond the intersection of the tip circles on the suction side in the rotation direction of the delivery gears, and communicates with a kidney/cardioid shaped suction chamber. A suction line communicates with the suction chamber. A feed zone is located behind the suction zone in the rotation direction of the delivery gears, said feed zone being fillable by excess pumping medium delivered by the gear pump through a channel under pressure and/or at an increased flowrate.

A gear pump of this type is the subject of German Patent Document DE 29 33 493 A1. The feed zone is connected with the pressure side of the pump and serves to fill with pumping medium the cavitation bubbles that appear particularly at higher pump rotational speeds, and thus to avoid implosion of the cavitation bubbles in the vicinity of a pressure zone, said implosion being associated with disturbing noises and dangerous pressure waves.

In accordance with German Patent Document DE 29 33 493 A1, an injector jet can be provided in the suction line in the flow direction upstream of the suction chamber, said jet likewise allowing pumping medium to be admitted from the pressure side of the pump. This is intended to improve the filling of the tooth spaces of the delivery gears with pumping medium at the suction zone. Clearly, cavitation bubbles cannot be avoided, so that these bubbles must be filled in the feed zone.

An object of the invention is to improve further a gear pump of the type described above.

This object is achieved according to the invention by virtue of the fact that the suction chamber that extends beyond the intersection on the suction side of the tip circles of the delivery gears is connected at that point with the feed zone.

The invention is based on the general idea of completely avoiding the formation of cavitation bubbles and not merely filling cavitation bubbles that form afterwards. By linking the suction chamber and feed zone, an area extending in the rotation direction of the delivery gears is obtained for filling the tooth spaces with pumping medium.

This clearly increases the pressure in the transitional area between the suction chamber and the feed zone, since the tooth spaces, which in the rotation direction of the delivery gears are located behind the intersection of the head circles of the delivery gears on the suction side, are supplied with delivery medium at an increased rate and/or at an increased pressure. As a result, complete filling is achieved.

The gear pump according to the invention therefore acts firstly as a delivery pump that supplies pumping medium to a consumer, and secondly as a charging pump which acts to fill the delivery spaces by creating a high flowrate or an increased pressure.

Since the gear pump according to the invention can operate free of cavitation even at very high rotational speeds, especially quiet operation is achieved because the pressure waves that would otherwise appear when the cavitation spaces coincide in the pressure zone of the pump are completely avoided.

By eliminating these pressure waves, the material stress on the pump elements is also clearly reduced so that the lifetime of the gear pump can be increased and materials less able to withstand loads, which are therefore less expensive, may be used.

Other objects, advantages and novel features of the present invention will become apparent from the following detailed description of the invention when considered in conjunction with the accompanying drawings.

DETAILED DESCRIPTION OF THE DRAWINGS

Figure 1:
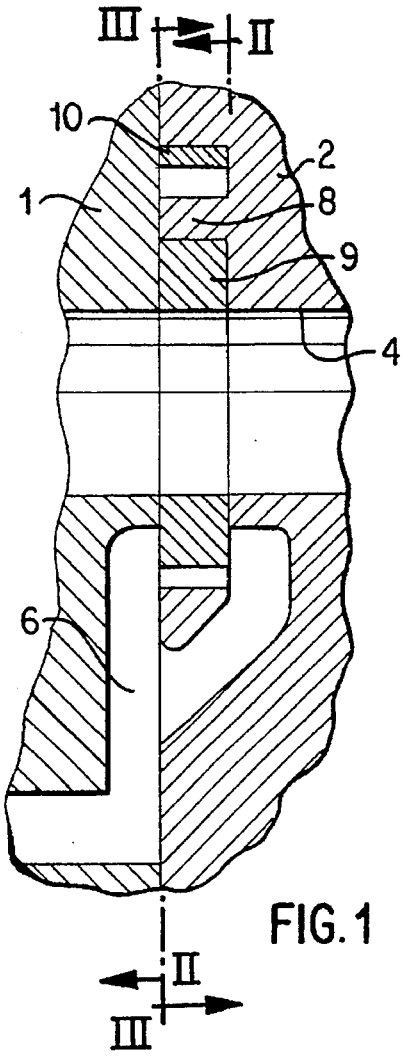
FIG. 1 is an axial sectional view through a gear pump constructed according to the invention, taken along section line I—I of FIG. 2.

A housing consisting primarily of two housing halves 1 and 2 arranged so that the flat surfaces thereof face and abut one another and define an interior chamber 3 that is essentially in the shape of a circular disk and made in the form of a recess in housing half 2. Chamber 3 is traversed by a bore 4 that extends perpendicularly to the plane of the disk and is eccentric with respect to the circular disk, and communicates at its ends in the vicinity of the lower half in FIG. 2 with a total of three channels 5 to 7 provided in housing halves 1 and 2. On the side of interior chamber 3 that is opposite the openings of channels 5 to 7, a filling body 8 is located inside interior chamber 3, which is crescent in shape in an axial view of bore 4, said body 8 being formed in housing half 2, the concave exterior of said body being designed and/or located concentrically with respect to the circular circumferential wall of interior chamber 3 and whose concave side is located concentrically with respect to the axis of bore 4.

A shaft, not shown, is rotatably mounted inside bore 4, said shaft being connected nonrotatably with a first delivery gear 9 accommodated in interior chamber 3, said gear being so dimensioned that its tip circle, which tangentially surrounds the tooth tips, closely abuts the concave side of filling body 8. Delivery gear 9 meshes with another delivery gear 10 designed as an internally toothed ring and closely surrounding filling body 8 on its concave side with its tip circle that runs tangentially over the tooth tips. Moreover, delivery gear 10 is so dimensioned that its outer circumference fits closely against the circular inner circumferential wall of interior chamber 3. Both delivery gears 9 and 10 are axially dimensioned in such fashion that they closely abut with their ends the adjacent ends of interior chamber 3.

The tip circles of delivery gears 9 and 10 intersect at crossing points 11 and 12 which are symmetrical with respect to an axial plane 13 that contains the axes of delivery gears 9 and 10.

Figure 2:
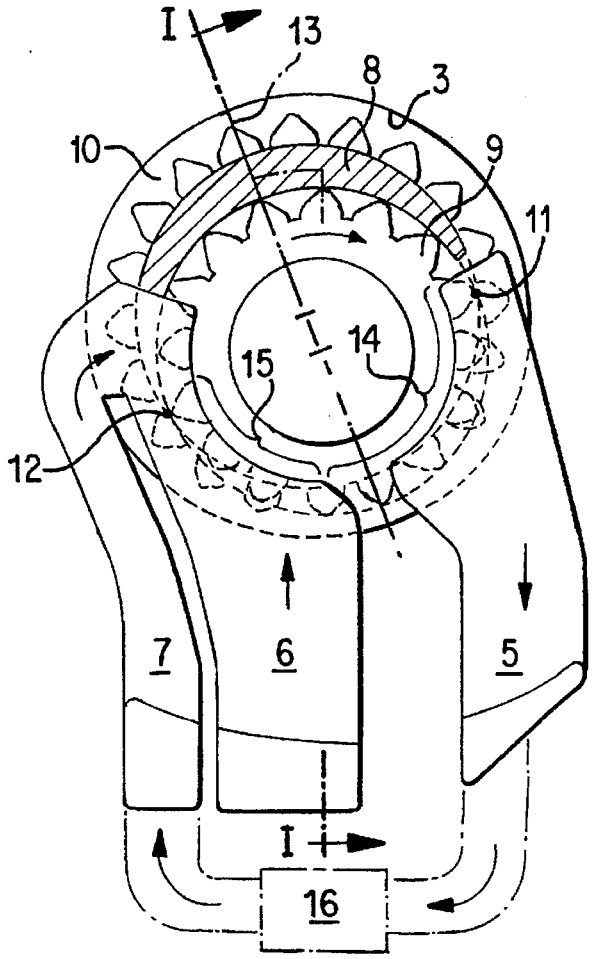
FIG. 2 is a radial sectional view corresponding to section line II—II in FIG. 1.
Figure 3:
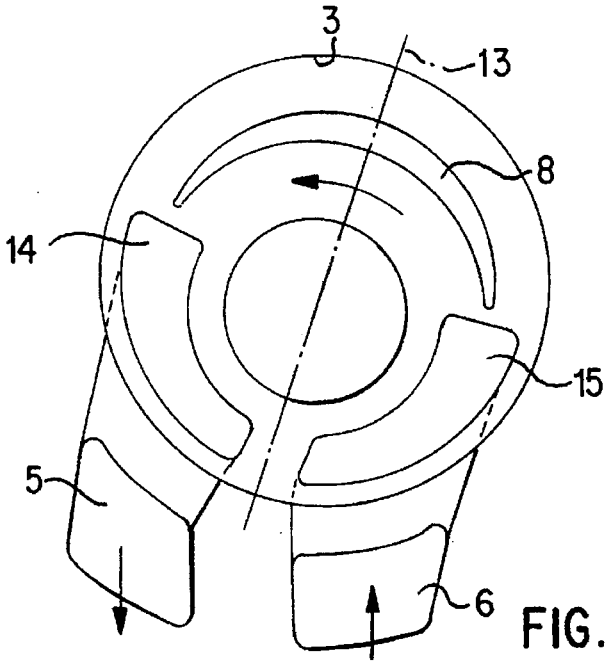
FIG. 3 is a section corresponding to section line III—III in FIG. 1.

When delivery gears 9 and 10 in FIG. 2 are rotating clockwise, spaces enclosed between adjacent teeth form between intersection 11 and axial plane 13 between the increasingly meshing teeth of delivery gears 9 and 10, said spaces narrowing as delivery gears 9 and 10 rotate, so that medium enclosed between delivery gears 9 and 10 is forced into channel 5 which, during operation of the pump, forms its pressure side or its pressure channel and whose opening connected with interior chamber 3 in the rotation direction of delivery gears 9 and 10 between intersection 11 and axial plane 13 is designed as a so-called kidney/cardioid shaped pressure chamber 14, which communicates with the above-mentioned spaces between the teeth of delivery gears 9 and 10.

Figure 1A:
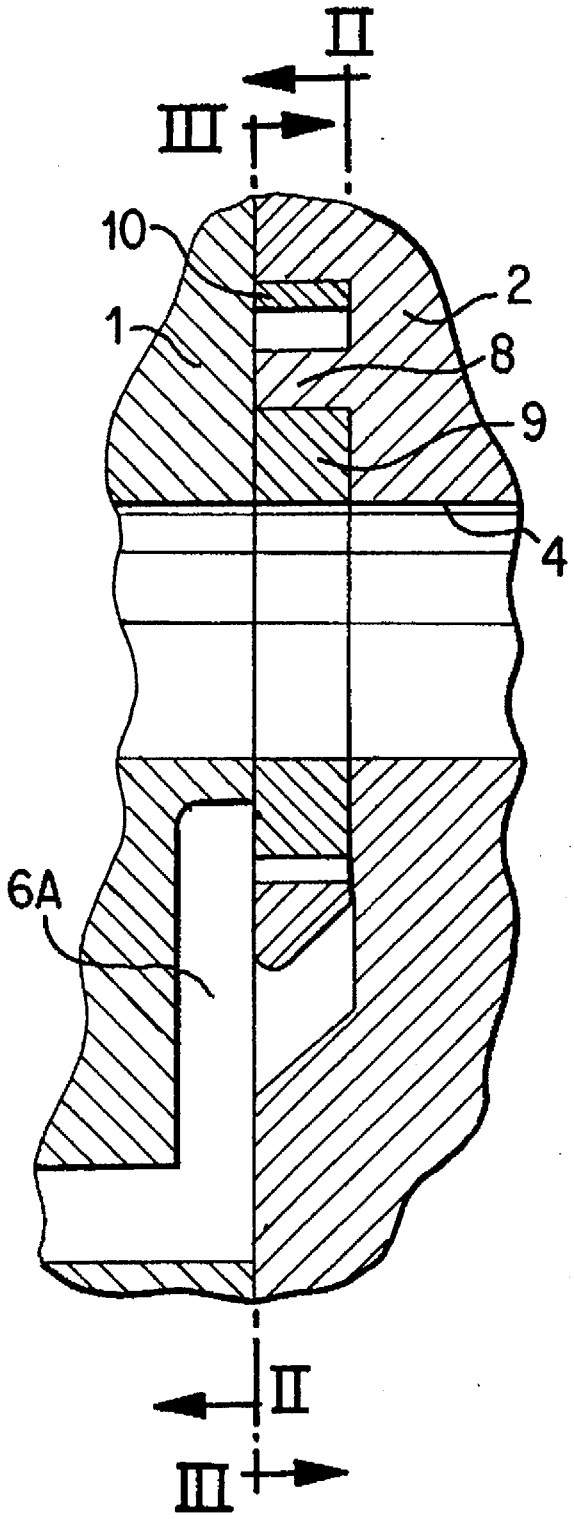
FIG. 1A is an axial sectional view, similar to FIG. 1, showing a modified gear pump with a feed zone on only one axial side of the delivery gears.

Between axial plane 13 and intersection 12 the spaces are surrounded by the meshing teeth of delivery gears 9 and 10, said spaces expanding as delivery gears 9 and 10 rotate and therefore receiving pumping medium from channel 6, which during operation of the pump forms its suction side or suction channel. For this purpose, channel 6 has openings designed as so-called kidney/cardioid shaped suction chambers 15 on both sides of delivery gears 9 and 10, said openings extending in the circumferential direction of delivery gears 9 and 10 from axial plane 13 to intersection 12. FIG. 1A schematically depicts an embodiment wherein the channel 6A opens to only one axial side of the delivery gears 9 and 10.

At least one of the suction chambers 15 extends in the rotation direction of delivery gears 9 and 10 beyond intersection 12 and connects there with channel 7 which is supplied with pumping medium from pressure channel 5 during operation of the pump.

During operation of the gear pump, suction channel 6 is connected with an oil supply for example, while pressure channel 5 leads to a consumer, from which the oil can flow back again to the oil supply, which is essentially at zero pressure. Accordingly, oil is delivered from suction channel 6 to pressure channel 5.

As a result of unavoidable throttle resistances, at higher rotational speeds, not enough oil can continue flowing through suction channel 6 to fill completely the spaces between the teeth of delivery gears 9 and 10 in the area between axial plane 13 and intersection 12. Unavoidable cavitation therefore occurs.

Since more oil is delivered at higher rotational speeds of the pump than the consumer requires, the excess oil delivered is conducted completely or partially by means of a through-flow regulating element 16 into channel 7, in which a comparatively high flowrate and/or a comparatively high oil pressure develops. Accordingly, spaces possibly produced by cavitation between delivery gears 9 and 10 in the vicinity of the opening of channel 7 are filled, with the consequence that no, or practically no, implosion of cavitation bubbles in the pumping medium can occur in the vicinity of pressure chamber 14.

With respect to effective avoidance of cavitation, it has proven advantageous to locate the mouth of channel 7 on only one side of delivery gears 9 and 10.

By virtue of the unilateral location of the opening of channel 7, comparatively high flowrates are achieved in the opening area, which could be advantageous for effective filling of possible gaps between delivery gears 9 and 10.

In contrast to the embodiment shown, filling body 8 can be eliminated. When the pump is operated, the corresponding space is filled as completely as possible with pumping medium.

In addition, it is also basically possible according to other contemplated embodiments to use a gear pump with external teeth instead of the gear pump shown, with internal teeth. It is only necessary to have an additional channel communicating with the tooth spaces of delivery gears 9 and 10 behind intersection 12 on the suction side in the rotation direction of delivery gears 9 and 10, said additional channel being forcibly filled with excess delivered pumping medium. In this manner, cavitation can be avoided even at very high rotational speeds.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Gear pump comprising:

first and second delivery gears having gear teeth meshing with one another with gear tip circles intersecting at crossing points at respective opposite sides of a plane through axes of said delivery gears, said gear teeth forming a pressure zone at one side of said plane and a suction zone at an opposite side of said plane, a suction chamber upstream of the suction zone and a suction line upstream of said suction chamber, a pressure chamber downstream of the pressure zone and a pressure line downstream of the pressure chamber, and a feed channel extending between the pressure line and a position opening to said gears at a location downstream of and adjoining the crossing point defining a downstream end of the suction chamber opening to the suction zone, said feed channel serving to supply one of high pressure and high flow rate medium to said pump to minimize cavitation at high pump speeds.

2. Gear pump according to claim 1, wherein said gears include a delivery gear with internal teeth and a delivery gear with external teeth.

3. Gear pump according to claim 1, comprising a fixed filler body partially filling the suction zone.

4. Gear pump according to claim 1, wherein two of said suction chambers are provided at respective opposite axial ends of said gears.

5. Gear pump according to claim 4, wherein the feed zone is located on only one axial side of the delivery gears.

6. Gear pump according to claim 5, wherein said gears include a delivery gear with internal teeth and a delivery gear with external teeth.

7. Gear pump according to claim 5, comprising a fixed filler body partially filling the suction zone.

8. Gear pump according to claim 1, wherein the feed zone is located on only one axial side of the delivery gears.

9. Gear pump according to claim 8, comprising a fixed filler body partially filling the suction zone.

* * * * *

UNITED STATES PATENT AND TRADEMARK OFFICE

CERTIFICATE OF CORRECTION

PATENT NO. : 5,660,531

DATED : August 26, 1997

INVENTOR(S) : Hans Merkle
Ralf Brunst

It is certified that error appears in the above-indentified patent and that said Letters Patent is hereby corrected as shown below:

On the title page, item [54] and column 1, line 1, the title should read:

-- GEAR PUMP WITH MINIMIZED CAVITATION --

Signed and Sealed this

Third Day of March, 1998

Bruce Lehman

*Attest:*

BRUCE LEHMAN

*Attesting Officer*

*Commissioner of Patents and Trademarks*